United States Patent [19]

Shaw

[11] Patent Number: 4,576,217

[45] Date of Patent: Mar. 18, 1986

[54] STATIONARY CONTINUOUS AUTOMATIC POURING PROCESS

[75] Inventor: Daniel Shaw, Saginaw, Mich.

[73] Assignee: General Motors Corporation, Detroit, Mich.

[21] Appl. No.: 627,222

[22] Filed: Jul. 2, 1984

Related U.S. Application Data

[62] Division of Ser. No. 348,287, Feb. 12, 1982, Pat. No. 4,509,578.

[51] Int. Cl.[4] ..... B22D 23/00

[52] U.S. Cl. ..... 164/130; 164/136

[58] Field of Search ..... 164/130, 135, 136, 322, 164/323, 324, 325, 329; 222/590

[56] References Cited

U.S. PATENT DOCUMENTS

| | | | |
|---|---|---|---|
| 2,997,757 | 8/1961 | Buhrer et al. | 164/135 |
| 3,188,704 | 6/1965 | Sukava | 22/79 |
| 3,645,321 | 2/1972 | Robinson | 164/252 |
| 3,780,789 | 12/1973 | Unger | 164/283 |
| 4,114,675 | 9/1978 | Buhrer | 164/4 |
| 4,227,565 | 10/1980 | Lavanchy et al. | 164/155 |

FOREIGN PATENT DOCUMENTS

| | | | |
|---|---|---|---|
| 2077809 | 11/1971 | France . | |
| 47-50966 | 12/1972 | Japan | 164/130 |
| 52-43723 | 4/1977 | Japan . | |

*Primary Examiner*—Nicholas P. Godici
*Assistant Examiner*—Richard K. Seidel
*Attorney, Agent, or Firm*—Lawrence B. Plant

[57] ABSTRACT

Process for the continuous casting of metal from a substantially stationary vessel wherein molds having elongated pouring basins are filled in increments via a plurality of serially arranged and sequentially actuated pouring spouts.

4 Claims, 7 Drawing Figures

STATIONARY CONTINUOUS AUTOMATIC POURING PROCESS

This is a division of application Ser. No. 348,287 filed on Feb. 12, 1982 now U.S. Pat. No. 4,509,578.

This invention relates to a process and apparatus for the substantially continuous pouring of molten metal from a stationary vessel into a series of molds moving successively through a pouring zone. More specifically, this invention relates to a process and apparatus which permits prolonged mold residence in the pouring zone and which is characterized by incrementally filling each mold via a plurality of serially arranged and sequentially actuated pouring spouts discharging melt into moving molds having extended pouring basins.

BACKGROUND OF THE INVENTION

Foundrymen have long poured metal by: indexing a mold under a pouring vessel (e.g., ladle) so as to register the mold gate with the pouring spout of the vessel; opening a valve (e.g., stopper) for a predetermined time interval to discharge the metal into the gate; closing the valve when the mold is filled; indexing the filled mold out of the pouring zone; and indexing an empty mold into place beneath the spout to repeat the cycle. Such systems are relatively slow due to the time lost while indexing the molds. Moreover, mold conveyors for such systems are subjected to repetitive starting and stopping which causes significant wear and tear thereon tending to erode the precision with which the gates and spouts can be registered. Hence, frequent and costly maintenance is required to insure accurate and reliable performance of the mold conveyor.

Foundrymen found that casting rates could be increased if the molds were equipped with extended (i.e., much larger than the mouths of the gates) pouring basins and the molds moved continuously through the pouring. zone Under these circumstances the extended (i.e., elongated in the direction of mold movement) pouring basins acted like funnels to direct the melt into the mold's gate and runner system. This also eliminated the need for precision gate-spout alignment equipment. The pouring rate of this equipment (i.e., for a given mold) was limited by the rate at which the melt could be discharged through the spout and mold residence time or length of time the mold basin remained beneath the pouring spout. For all practical purposes mold residence time was determined by the speed of the mold conveyor. Fast moving conveyors reduced mold residence time and hence was useful only with molds having small cavities. Slower moving conveyors were needed for large cavity molds.

Foundrymen continued to seek ways to increase the amount of metal that could be poured in a given time and, at the same time, reduce the manpower required to pour the metal. To this end, highly sophisticated automatic equipment such as described in U.S. Pat. No. 3,977,461, issued Aug. 31, 1976, was developed, and included coupling a mobile ladle to a mold in a pouring station such that the mold and ladle move together during the pour and thereby assure adequate residence time. A plurality of ladles are provided and each ladle carries only as much melt as is needed to pour a single mold. Such equipment is extremely complex, expensive, and replaces existing casting lines in most foundries where it is used.

It is the principal object of the present invention to provide a simple, economical, and automatic process and apparatus for pouring melt into each of a series of successive molds moving continuously through a pouring zone, which method/apparatus achieves prolonged mold residence time with a minimum of change to existing casting lines and which is characterized by incrementally filling each mold via a plurality of serially arranged and sequentially actuated pouring spouts aligned in the direction of mold travel through a pouring zone. This and other objects and advantages of the present invention will become more readily apparent from the detailed description thereof which follows and which is given in conjunction with the several drawings wherein:

FIGS. 1*a* through 1*d* are side-section views schematically illustrating the invention at various stages of pouring;

BRIEF DESCRIPTION OF THE INVENTION

Figure 1A:
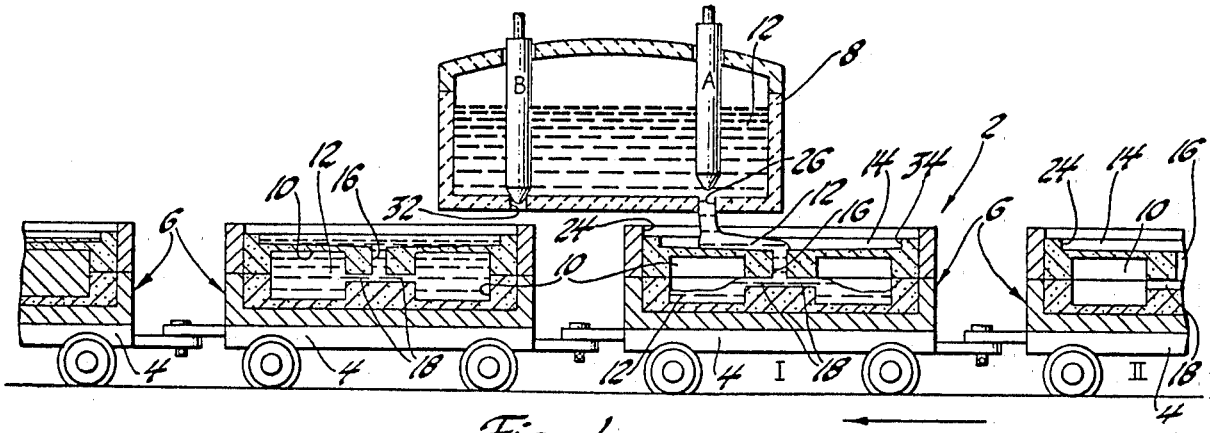
Figure 1B:
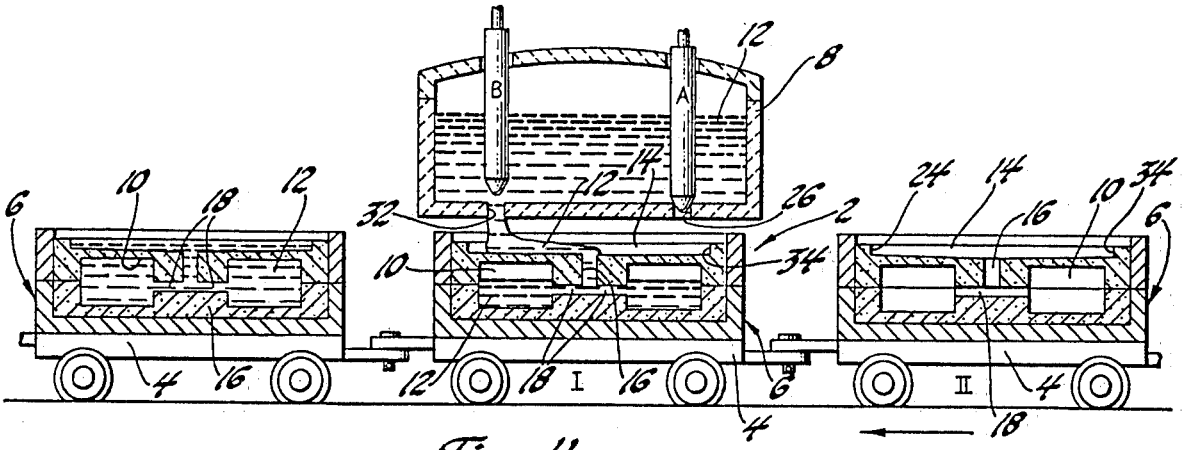
Figure 1C:
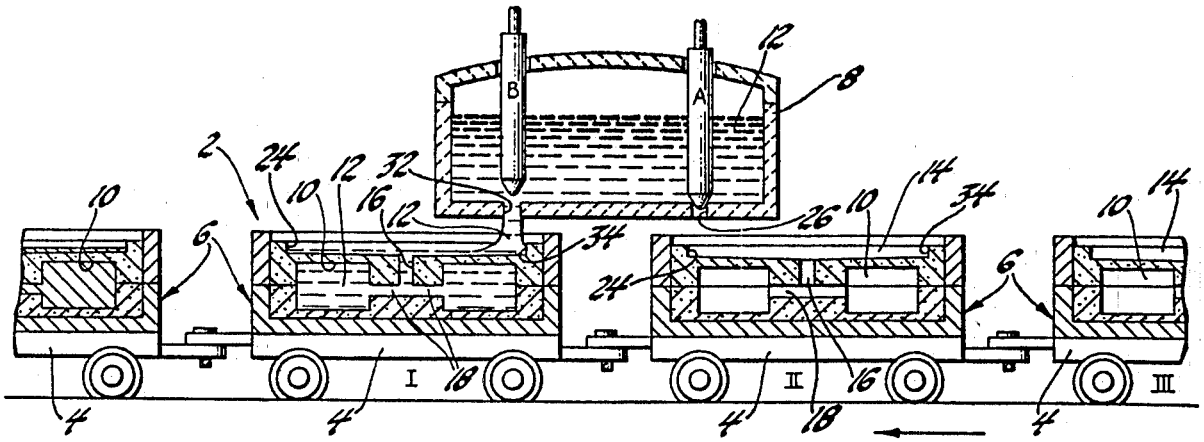

The present invention comprehends a method for pouring molten metal incrementally into each of a series of successive molds moving continuously through a pouring zone and apparatus for effecting that process. The molds move beneath the pouring spout of a vessel for holding and dispensing the melt. The melt dispensing vessel remains stationary during pouring and has a series of pouring spouts or outlets aligned in the direction of mold movement. The vessel will typically have enough melt capacity to fill about ten molds and will be kept full by a ladle which shuttles back and forth between the pouring vessel and a furnace. Valves associated with the spouts control melt flow through the spouts and are opened and closed in sequence relative to the position of a mold being poured. Each mold is filled in increments via a pouring basin extended (e.g., elongated) in the direction the molds move through the pouring zone for receiving melt over a substantial length of the mold. That is to say, each spout pours only part of the mold's total requirements as the extended basin passes beneath the particular spout. Hence as the mold traverses beneath the series of spouts, its pouring basin is progressively aligned with one spout after the other. Pouring is possible at any time the spouts are aligned with the basin, and more than one spout can be pouring at one time depending on how the system controls are set and the casting rate desired. Preferably the spouts are poured in sequence with no pouring overlap between two adjacent spouts. Pouring continues until all spouts in the series have contributed their individual melt increment to the mold being poured. Pouring of the next mold begins immediately and may occur while the last spout finishes off the preceding mold. As a result of pouring from more than one spout, the residence time of the mold with respect to the pouring vessel is increased even though the mold conveyor speed is quite high and the residence time with respect to any one spout is insufficient to fill the mold.

The process is automated by means of conventional sensors and controllers. The sensors (e.g., proximity switches) determine the location of each mold with respect to the several pouring spouts and cue the controller to direct the opening and closing of the appropriate melt flow valves in response to the mold location. In a preferred embodiment the opening and closing of the valves are such that only one spout pours at a time and a timer is used to control the duration of the total pour (i.e., the summation of the pours from each spout). In this latter regard, the timer starts when the first valve in the series opens, will continue to run after the first valve closes and the second opens, and will finally effect closing of the last valve when the predetermined length of the total pour has expired. The length of the pour is determined by the metal flow rate through the spouts and the size of the mold cavity. As the timed pouring progresses, the first valve closes and subsequent valves will open and close in sequence.

Apparatus in accordance with the present invention comprises a substantially stationary (i.e., during pouring) vessel means for holding melt at a pouring zone in proximity to a mold conveyor. The vessel means may comprise a single vessel with one or more compartments, or even several separate vessels each holding its own melt. A series (i.e., two or more) of melt discharge outlets or spouts associated with the vessel are spaced apart in the direction the molds move through the pouring zone. Preferably the several spouts are stopper valve controlled and located in the floor of a single compartment vessel positioned directly over the mold line for simple, direct, gravity discharge of melt into the mold. The stopper-valves are actuated (i.e., mechanically, hydraulically or pneumatically) to open and close in sequence the timing of which is dictated by the location of the mold to be poured with respect to the pouring spouts. Hence though the sequence remains the same the timing may vary from mold to mold as the speed of the conveyor changes. More specifically, sensors are located adjacent the mold line to determine the position of the mold to be poured and to signal a controller to effect the opening and closing of the valves. Preferably the sensors are located remote from the pouring zone and preferably upstream of the mold being poured. A train of identical, equispaced molds permits sensing the location of a trailing mold as an accurate indication of the position of the mold to be poured

OPERATION OF THE PROCESS/APPARATUS

The process and function of the apparatus of the present invention may be better understood by reference to FIGS. 1*a* through 1*d* and 2 which schematically depict the operation of a preferred, two-spout embodiment of the invention. A mold conveyor line 2 comprises a train of equispaced cars 4 for moving a plurality of molds 6 through a pouring zone beneath a melt holding vessel 8, which has sufficient melt capacity to fill about ten of the molds 6. The molds 6 each include several cavities 10 for shaping the melt 12 cast therein. An elongated pouring basin 14 is provided atop the cope portion of the mold 6 and extends almost the full length of the mold 6 in the direction the mold 6 moves through the pouring zone. The pouring basin 14 slopes gently toward the gate 16 and serves to funnel melt 12 toward the gate 16 regardless of where the melt enters the basin 14. Melt 12 from gate 16 enters the cavities 10 via runners 18.

The Figures depict a conveyor moving from right to left with the cars 4 designated with Roman Numerals. FIG. 1*a* depicts the pouring of mold I shortly after it has entered the pouring zone under vessel 8. Valve stopper A has opened and the first increment of melt 12 begun to fill the cavities 10 through spout 26. Flow will continue through spout 26 as mold I traverses from right to left to the position shown in FIG. 1*b*. When mold I reaches the position shown in FIG. 1*b*, valve stopper A closes and valve stopper B opens and the next increment (i.e., in this case, final increment) of melt 12 flow begins to fill the cavities 10 through spout 32. Flow through spout 32 will continue until the predetermined duration of the total pour (i.e., through all spouts) has timed-out. At this time, stopper valve B is closed and the casting of mold I complete. Assuming no stoppage or slowing of the conveyor line 2, cessation of pouring would normally occur when mold I has reached about the position shown in FIG. 1*c* and mold II is in position to commence filling (see FIG. 1*d*).

Figure 1D:
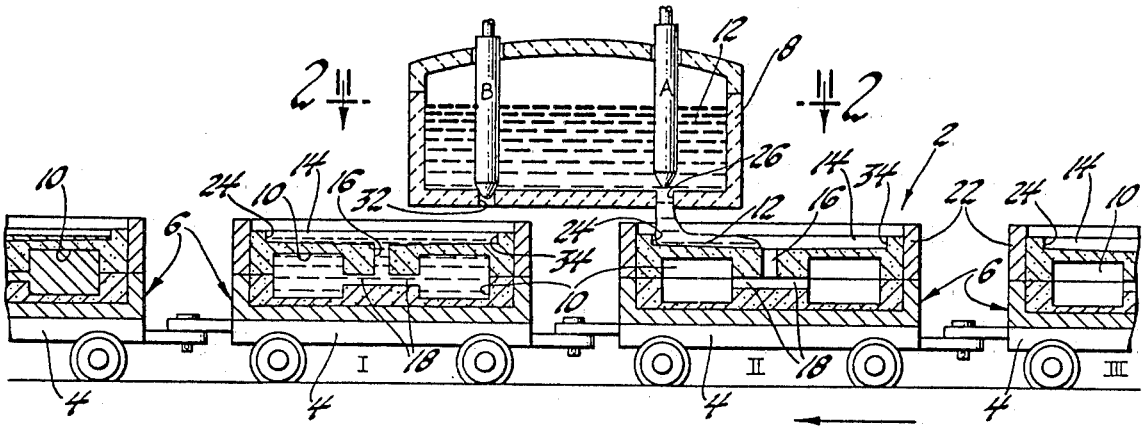
Figure 2:
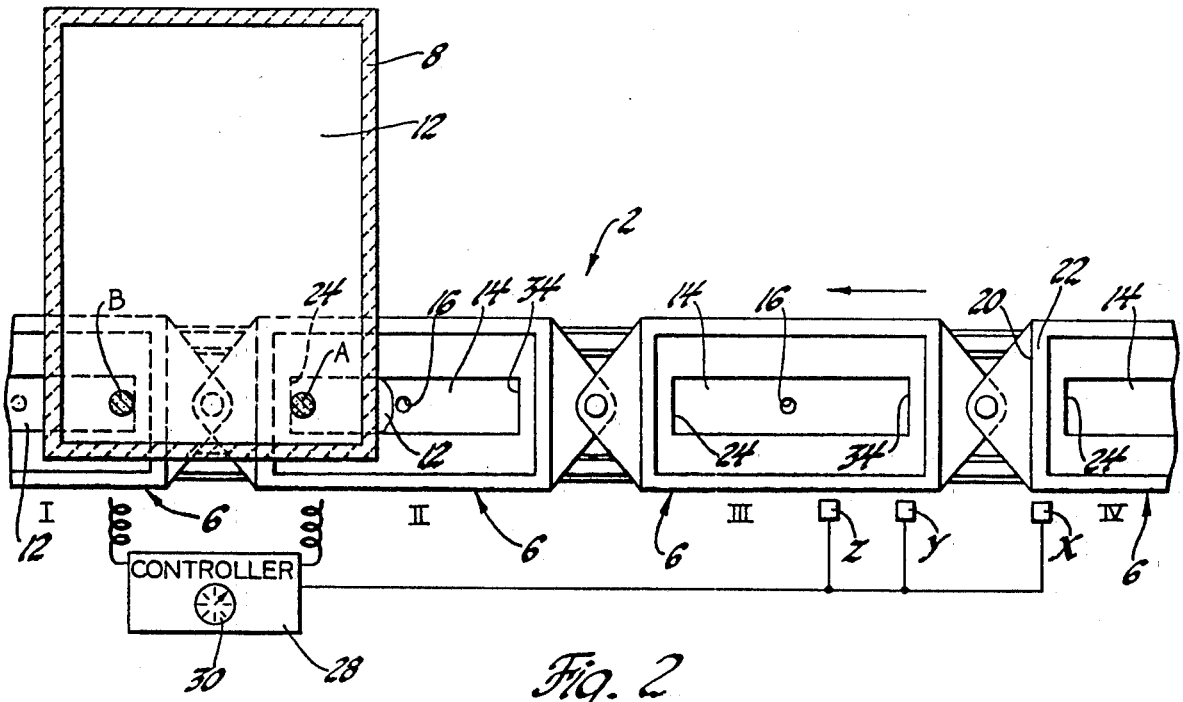
FIG. 2 is a view in the direction 2—2 of FIG. 1*d* and depicts the positional relationships between the pouring spouts, the pouring basins and the mold locating sensors.

Pouring according to the sequence depicted in FIGS. 1*a* through 1*d* is automatically controlled in the manner described hereafter in conjunction with FIG. 2. A series of magnetic proximity switches X, Y and Z are provided upstream of the pouring zone and are spaced apart so as to provide the desired timing between the opening and closing of the valves. The leading edge 20 of the metal flask 22 for mold IV enters the operational zone of magnetic proximity switch X just as the leading edge 24 of the pouring basin 14 of mold II has passed beneath the first spout 26. At this time the switch X signals a controller 28 to open stopper valve A and start the running of the pouring timer 30. Pouring from spout 26 continues until the leading edge 20 of the flask 22 reaches proximity switch Y, whereupon switch Y signals the controller 28 to shut stopper valve A and open stopper valve B (see FIG. 1*b*). The timer 30 continues to run throughout the opening and closing of stoppers A and B to time out the remainder of the total pour time to be completed through spout 32. When the total pour time has elapsed, stopper valve B is closed (see FIG. 1*d*) and filling of mold I complete. In the event the mold conveyor 2 stops before stopper valve B opens, pouring will continue from spout 26 for the complete timed cycle and stopper B is deactivated until after the next mold arrives for pouring. A safety proximity switch Z insures that all pouring ceases by the time the trailing edge 34 of the basin 14 of the mold being poured reaches the last spout 32 in the series. The point (i.e., relative to a pouring basin) at which commencement of pouring through either spout 26 or spout 32 begins can be readily changed by merely repositioning the switches X and Y as desired.

While two spouts is all that is needed for most applications any number of additional spouts can be added and appropriate controls therefore provided to meet a particular casting requirement. Moreover it is obvious in the case of FIG. 1*b* that the controls can be adjusted so that spouts 26 and 32 both pour simultaneously for part of the pouring cycle so long as both remain in alignment with the pouring basin 14 of the mold being poured. Likewise, when the molds 6 are as close together as depicted in FIG. 1*d*, the sensors and controllers may be adjusted to commence pouring the trailing mold (i.e., mold II) through spout 26 while still pouring the leading mold (i.e., mold I) through spout 32.

DETAILED DESCRIPTION OF SPECIFIC APPARATUS

Figure 3:
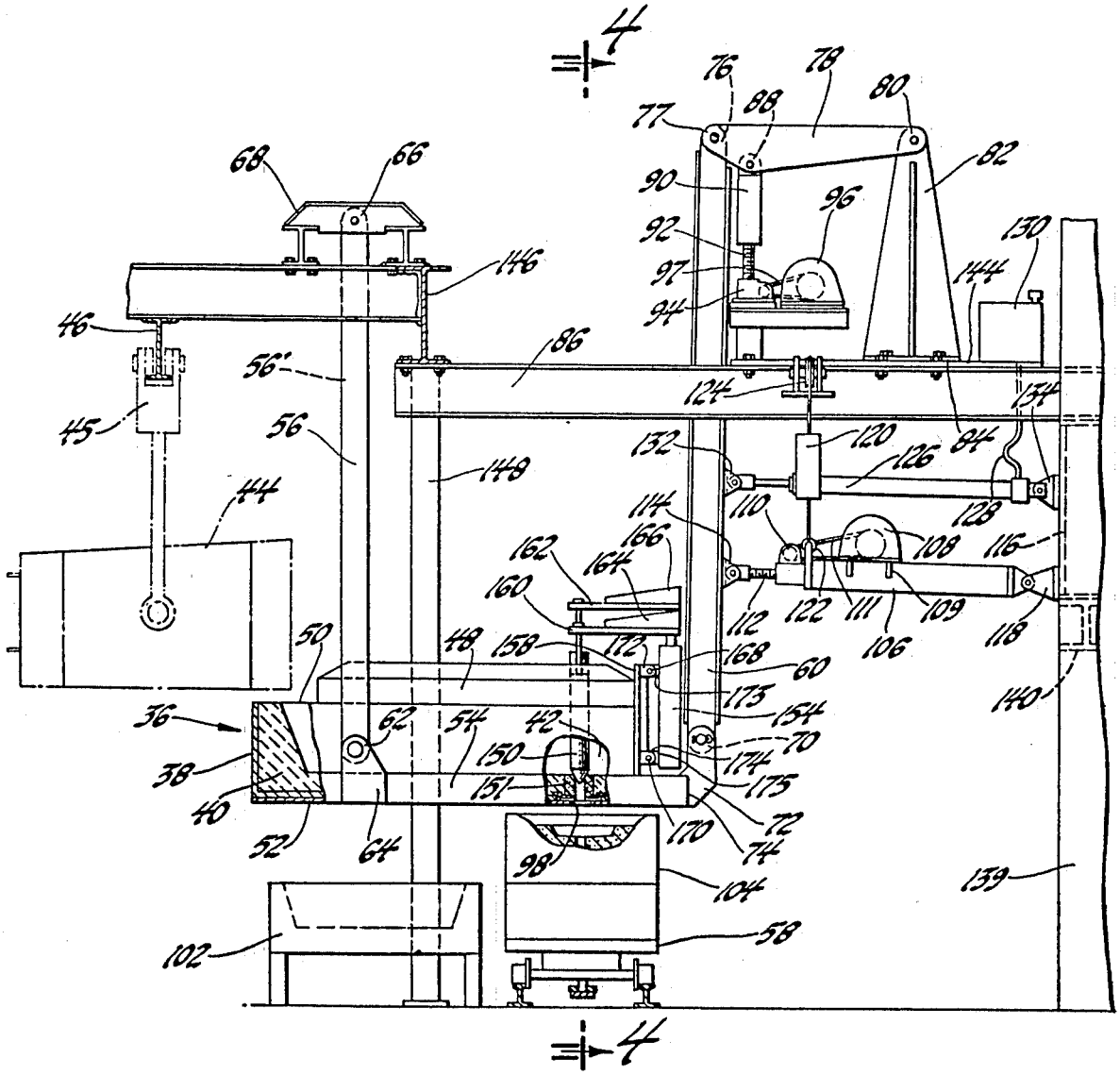
FIG. 3 is a partially broken away, side-elevational view of apparatus according to the present invention; and, FIG. 4 is a sectional view taken in the direction 4—4 of FIG. 3.
Figure 4:
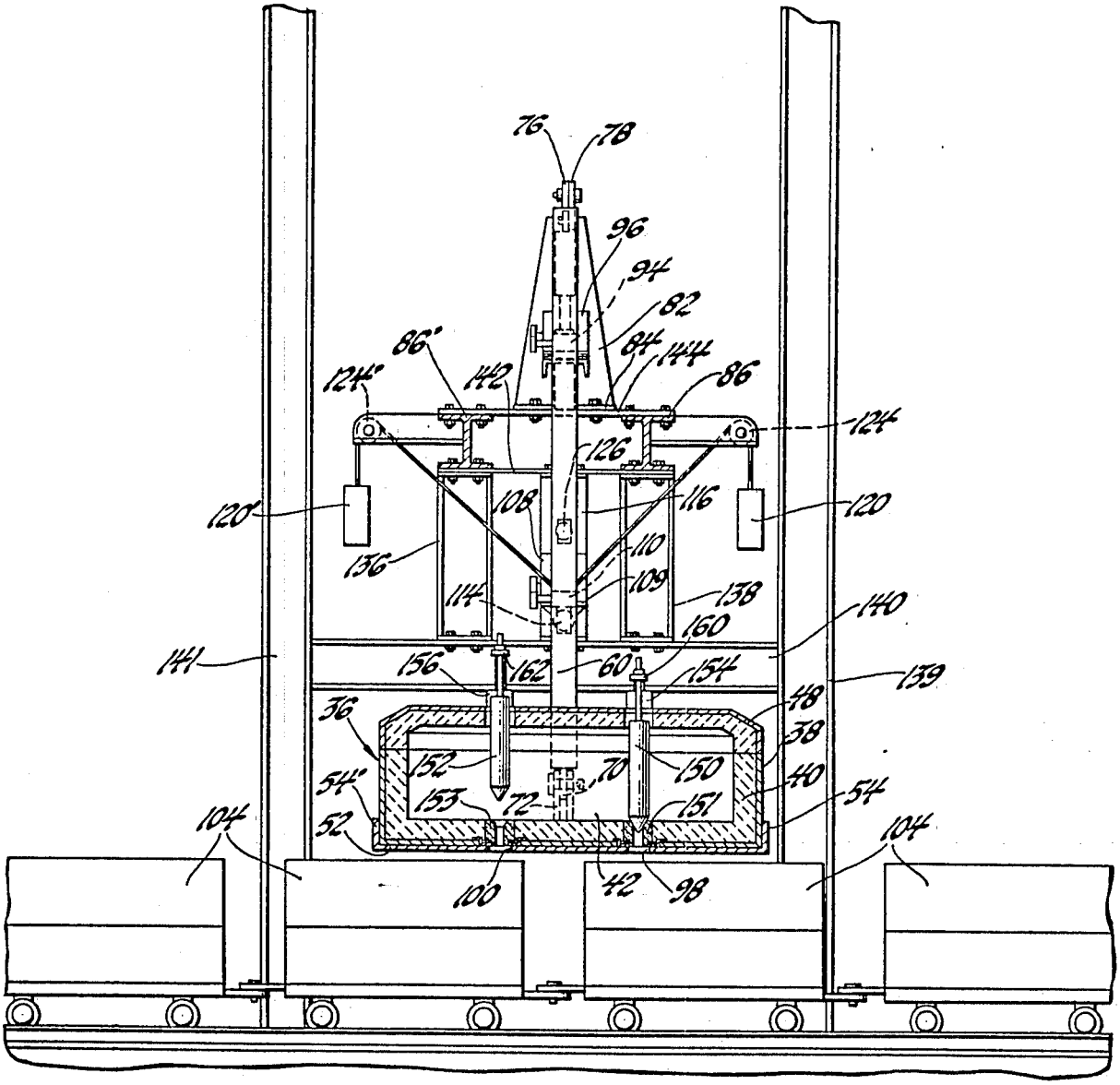

FIGS. 3 and 4 show a casting vessel 36 comprising a steel outer shell 38 and a refractory lining 40 defining a cavity 42 for holding the melt to be poured. The vessel 36 is charged with melt from a trolley-borne 45 ladle 44 (shown in phantom) which traverses an overhead track 46 between a furnace and the vessel 36. A cover 48 covers most of the vessel 36 leaving only a small opening 50 at the front thereof for receiving melt from the traversing ladle 44. The vessel 36 is carried by a cradle 52 having upstanding lateral flanges 54 and 54'. The cradle 52 is suspended above the mold line 58 and from the supporting overhead I-beam framework by means of three pendant arms adapted to pivot with respect to the tray 52 and the overhead framework. More specifically, the front of the cradle 52 (i.e., nearer the ladle 44) is supported on both sides (i.e., at lateral flanges 54 and 54') by two opposing forward arms 56 and 56' (i.e., arm 56' is hidden behind arm 56) while the back of the cradle 52 (i.e., nearer the mold conveyor 58) is supported at its center by the remaining pendant rearward arm 60. The lower ends of the forward pendant arms 56 and 56' are pivotally connected (see 62 for arm 56) to gussets (see 64 for arm 56) welded to the flanges 54 and 54' while the upper ends of the pendant arms 56 and 56' are pivotally connected (see 66 for arm 56) to the overhead support 68. Similarly the lower end 70 of rearward pendant arm 60 is pivotally connected to a U-shaped bracket 72 anchored at the center of the back edge 74 of the cradle 52 while its upper end 76 is pivotally connected to one end 77 of cross arm 78. The cross arm 78 is pivotally connected at its other end 80 to a pedestal 82 which in turn is rigidly anchored at 84 to overhead I-beam 86 of the structural framework. The upper end 88 of a screw jack 90 is pivotally connected to the cross arm 78 and is caused to extend or retract incident to movement of the screw 92 by gear box 94 which is driven by motor 96 through the chain 97. Extension and retraction of the screw jack 90 permits raising and lowering of the back end of the cradle 52 to provide virtually any desired angular orientation of the vessel 36 during pouring, dumping, cleaning or the like.

Pivoting pendant support arms 56, 56', and 60 permit the shifting of the pouring vessel 36 from the pouring position shown in FIG. 3 to a dumping position over the receptacle 102. In this regard, it is occasionally necessary to dump the melt from the vessel 36 when it cannot effectively be cast into the molds 104. Such a condition may occur, for example, when the mold conveyor 58 breaks down and the melt in vessel 36 cannot be poured before solidifying. To dump the melt, the vessel 36 is shifted such that its spouts 98 and 100 are over the receptacle 102 and the valves then opened to discharge the melt. Shifting of the vessel 36 from the pouring position to the dumping position is effected by means of screw jack 106 which is energized by motor 108 acting through gear box 110 via chain 111. The motor 108 rests on a shelf 109 appropriately secured to the top of the screw jack 106. The gear box 110 extends the screw 112 so as to act upon the pendant arm 60 and thereby shift the vessel 36 to the left in substantially parallelogram fashion. The screw jack 106 is pivotally attached at one end to the arm 60 via U-shaped bracket 114 and at its other end to I-beam 116 of the framework via U-shaped bracket 118. Counter-weights 120 and 120' are attached to the screw jack 106 at ring 122 and, acting via pulleys 124 and 124', serve to prevent the screw jack 106 from buckling or jackknifing while in the extended position. An hydraulic cylinder 126 is connected via hydraulic line 128 to an oil reservoir 130 and serves as a shock absorber to dampen any rapid return of the vessel 36 from the dumping position in the event the screw jack 106 fails. The hydraulic cylinder 126 is pivotally attached at one end to the arm 60 via U-shaped bracket 132 and on the other end to the I-beam 116 via U-shaped bracket 134.

The I-beam 116 is flanked by two I-beams 136 and 138 (i.e., rotated 90 degrees from beam 116) and the three beams together serve to support the ends of the overhead beams 86 and 86' on the cross beam 140 between the upright framework I-beams 139 and 141. The other ends of the overhead support beams 86 and 86' are appropriately secured to the transverse horizontal cross beam 146 of the framework which in turn is supported above the floor by several pillars 148 located substantially on either side of the cradle 36. Cross plate 142 links the beams 86 and 86' to the beams 116, 136 and 138 while the cross plate 144 joins the beams 86 and 86' and forms a supporting platform for the pedestal 82, screw jack 90 and reservoir 130.

As indicated above, pouring of the molds 104 is effected by the sequential seating and unseating of valve stoppers 150 and 152 in their respective valve seats 151 and 153 which serve to control the flow of melt through the corresponding spouts 98 or 100. The stoppers 150 and 152 are actuated by pneumatic cylinders 154 and 156 respectively and according to the dictates of controller 28 (see FIG. 2). The hydraulic cylinders 154 and 156 are secured to the backside of the vessel 36 via brackets 158. Horizontal arms 160 and 162 couple the hydraulic cylinders to the valve stoppers and are stiffened against bending by gussets 164 and 166. Eccentric shafts 168 and 170 acting through ears 172 and 174 of bracket 158 and lugs 173 and 175 of the cylinders permit adjustment of the cylinders 154 and 156 and their associated arms 160 and 162 for proper alignment with the stoppers.

While this invention has been described primarily in terms of a specific embodiment thereof it is not intended to be limited thereto but rather only to the extent set forth hereafter in the claims which follow.

The embodiments of the invention in which an exclusive property or privilege is claimed are defined as follows:

1. A method of pouring metal melt into each of a plurality of successive molds moving substantially continuously through a pouring zone comprising the steps of:

passing said molds successively beneath a series of pouring outlets for sequentially dispensing increments of said melt to each of said molds, said series having a first and a last outlet aligned substantially in the direction of said moving, and said molds each having a cavity for shaping the melt and an extended pouring basin aligned substantially in the direction of said moving for receiving the melt from said outlets and directing it into said cavity;

first pouring melt from said first outlet as said pouring basin moves beneath said first outlet, said first poured melt being sufficient only to partially fill said cavity;

discontinuing said first pouring before said pouring basin passes out from beneath said first outlet;

last pouring melt from said last outlet as said pouring basin moves beneath said last outlet, said last poured melt being sufficient to completely fill said cavity; and discontinuing said last pouring before said pouring basin passes out from beneath said last outlet.

2. A method of pouring metal melt into each of a series of successive molds moving substantially continuously through a pouring zone beneath a substantially stationary holding vessel for said melt comprising the steps of:

passing said molds successively beneath first and second pouring outlets in said vessel for sequentially dispensing increments of said melt to each of said molds, said outlets being aligned substantially in the direction of said moving, and said molds each having a casting cavity for shaping melt and an extended pouring basin aligned in the direction of said moving for receiving the melt from said outlets and directing it into said cavity;

first pouring melt from said first outlet as said pouring basin moves beneath said first outlet, said first poured melt being sufficient only to partially fill said cavity;

discontinuing said first pouring before said pouring basin passes out from beneath said first outlet;

second pouring melt from said second outlet as said pouring basin moves beneath said second outlet, said second poured melt being sufficient to further fill said cavity; and discontinuing said second pouring before said pouring basin passses out from beneath said second outlet.

3. A method of pouring metal melt into each of a plurality of successive molds moving substantially continuously through a pouring zone comprising the steps of:

passing said molds successively beneath a series of pouring outlets for sequentially dispensing increments of said melt to each of said molds, said series having a first and a last outlet aligned substantially in the direction of said moving, and said molds each having a cavity for shaping the melt and an extended pouring basin aligned in the direction of said moving for receiving the melt from said outlets and directing it into said cavity, said pouring basin being defined in part by a leading edge and a trailing edge considered in relation to the direction said molds move through said zone;

commencing a first pouring of melt from said first outlet shortly after said leading edge of said pouring basin passes beneath said first outlet;

continuing said first pouring for a time sufficient only to partially fill said cavity with melt;

commencing a last pouring of melt from said last outlet after said leading edge of said pouring basin passes beneath said last outlet;

continuing said last pouring for a time sufficient to completely fill said cavity with melt;

discontinuing said first pouring before said trailing edge of said basin passes beneath said first outlet; and discontinuing said last pouring before said trailing edge of said pouring basin passes beneath said last outlet.

4. A method of pouring metal melt incrementally into each of a series of successive molds moving continuously through a pouring zone comprising the sequential steps of:

passing each of said molds successively beneath first and second pouring outlets for dispensing said melt into said molds, said molds each having a cavity for shaping the melt and an extended pouring basin for receiving the melt from said outlets and directing it into said cavity, said pouring basin being defined in part by a leading edge and a trailing edge considered in relation to the direction said molds move through said zone;

commencing a first pouring of melt from said first outlet shortly after said leading edge of said pouring basin passes beneath said first outlet said first poured melt being sufficient only to partially fill said cavity;

substantially simultaneously discontinuing said first pouring and commencing a second pouring of melt from said second outlet after said leading edge of said pouring basin passes beneath said last outlet said second poured melt being sufficient to completely fill said cavity; and discontinuing said second pouring after a predetermined time interval has elapsed which interval commences at the commencement of said first pouring.

* * * * *